United States Patent [19]

Thompson

[11] 4,156,332

[45] May 29, 1979

[54] KNOCKDOWN SIGN POST ASSEMBLY

[76] Inventor: Earl M. Thompson, Box 2612, Burlington, N.C. 27215

[21] Appl. No.: 828,273

[22] Filed: Aug. 29, 1977

[51] Int. Cl.[2] ..... E02D 5/74

[52] U.S. Cl. ..... 52/165; 52/297

[58] Field of Search ..... 40/125 H, 145 R, 10 D; 52/165, 297, 728, 155–157, 116; 256/DIG. 5

[56] References Cited

U.S. PATENT DOCUMENTS

| | | | |
|---|---|---|---|
| 47,910 | 5/1865 | Sheilds | 52/165 |
| 199,949 | 2/1878 | Youngs | 52/165 |
| 291,927 | 1/1884 | Newton | 256/DIG. 5 |
| 396,624 | 1/1889 | Thomas | 52/165 |
| 427,815 | 5/1890 | Wolf | 52/155 |
| 852,555 | 5/1907 | Glassco | 52/116 |
| 891,448 | 6/1908 | Snider | 52/165 |
| 930,607 | 8/1909 | Morrill | 256/DIG. 5 |
| 1,038,147 | 9/1912 | Johnson | 52/165 |
| 2,554,887 | 5/1951 | Tricarico | 52/165 |
| 2,976,346 | 3/1961 | Bellamy | 52/165 |

*Primary Examiner*—James L. Ridgill, Jr.

[57] ABSTRACT

This invention consists of a knockdown sign post assembly which provides the user with a sign post that can easily be erected and taken down in a quick and efficient manner. The foundation or base of the sign post is readily placed into the ground to which the post for the sign attachment is affixed. Disassembly consists of disengaging the post from the foundation and then removing the foundation from the ground.

19 Claims, 10 Drawing Figures

KNOCKDOWN SIGN POST ASSEMBLY

BACKGROUND AND OBJECTIVES OF THE INVENTION

For many years realtors and others who use small signs as are normally placed on buildings' lawns, for example, to advertise that the buildings are for sale or for rent, have been confronted with the problem of erecting the sign quickly, on a temporary basis, so the signs may be removed as in the event the buildings are sold or rented. A sign post for such a sign must be capable of quick erection and disassembly and cannot adversely affect the lawn or its surrounding site and must be sturdy enough to withstand forces of wind, rain and snow without being damaged and without losing its upright posture.

With this background in mind the present invention was conceived and one of its main objectives is to provide a knockdown sign post assembly which is easily erected and "knocked down" or disassembled.

It is another objective of the present invention to provide a knockdown sign post assembly which is simply constructed and easily transported.

It is still another objective of the present invention to provide a knockdown sign post assembly which is relatively inexpensive yet when in assembled form provides a durable and stable sign post.

SUMMARY OF THE INVENTION AND DESCRIPTION OF THE DRAWINGS

This invention consists of a sign post assembly which includes a foundation member which is driven or urged into the ground and which has an upright engaging structure. The sign post is, for example, slotted along its terminal end and engages the upright structure of the foundation member. Securing rods or bolts are then directed through holes in the post which align with holes in the upright structure of the foundation member to secure the post in rigid engagement with the foundation member. Disassembly of the sign post can easily be done by removing the securing rods or bolts, lifting the sign post from the foundation member, and then urging the foundation member out of the ground. The assembly and disassembly can easily be done by unskilled workers in a matter of minutes as no post hole digging is necessary, and no concrete or other materials including wires are required to hold the sign post in a firm, upright posture.

Turning now to the drawings;

FIG. 1 demonstrates a typical embodiment of the knockdown sign post assembly of the present invention in an assembled, erected illustration;

FIG. 2 demonstates the lower portion of the knockdown assembly shown in FIG. 1, in an exploded view;

Figure 5:
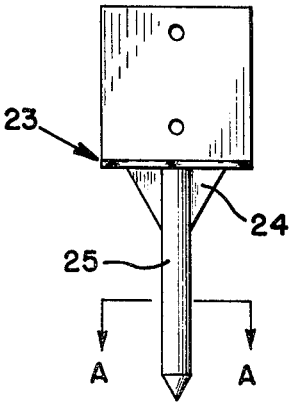
Figure 7:
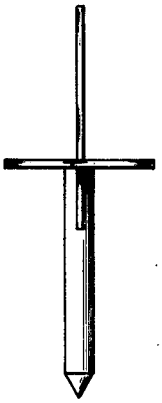
Figure 8:
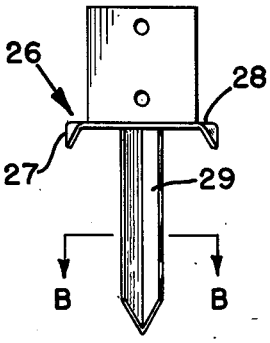
Figure 6:
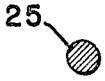
Figure 9:
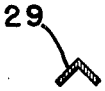

FIG. 5 demonstrates another embodiment of a foundation member;

FIG. 6 shows a cross-sectional view of the earth penetrating portion of the foundation member of FIG. 5 along lines A—A;

FIG. 7 is an illustration of a side view of FIG. 5;

FIG. 8 is yet another embodiment of a foundation member;

FIG. 9 is a cross-section through lines B—B of FIG. 8; and

Figure 10:
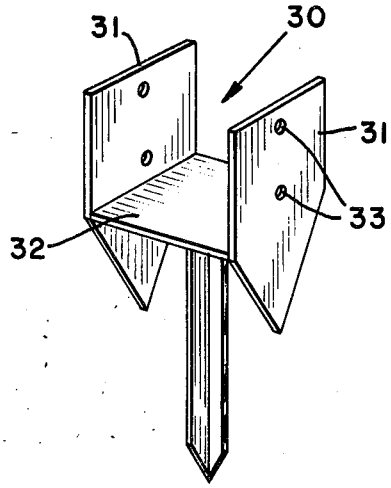

FIG. 10 is yet another embodiment of a foundation member.

Figure 1:
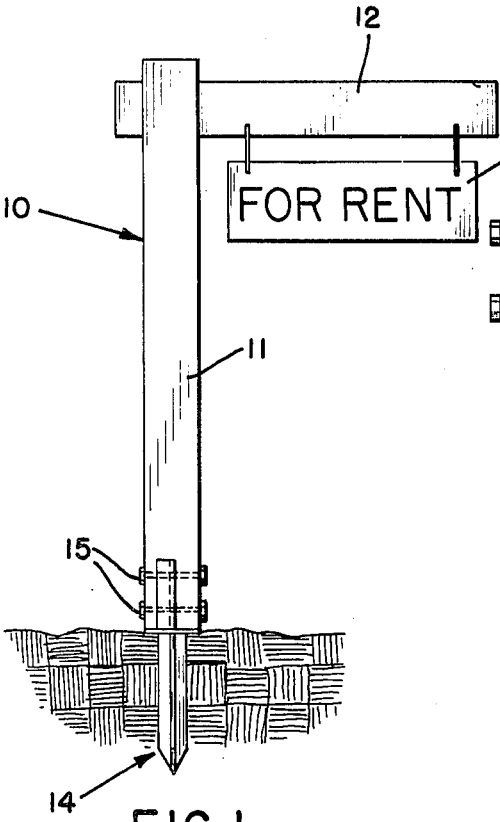

For a more detailed description of the invention, FIG. 1 demonstrates an erected version of the knockdown sign post assembly including sign post 11, crossbar 12 and a conventional "For Rent" sign 13. Post 11 is releasably engaged to foundation member 14 and is fastened thereto by securing bolts 15.

Figure 2:
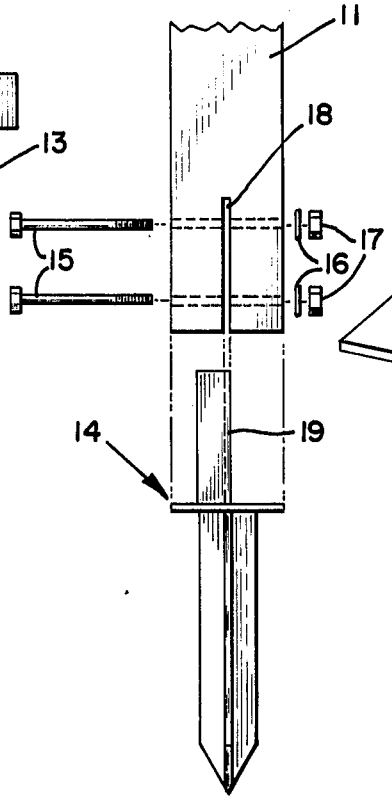

The knockdown assembly shown in FIG. 2 is an exploded view of the lower portion of FIG. 1 with post 11 being disengaged from foundation member 14. Securing bolts 15 are shown as having threaded ends for engagement with the securing washers 16 and securing nut members 17 although other securing means may be employed. Post 11 is shown with its terminal end containing slot 18 which slidably contacts post engaging means 19 which is L-shaped on this, the preferred embodiment, though other cross-sectional configurations and shapes such as "X", "T" or "V" which are shown in FIG. 12 as 35, 36 and 37 respectively and may be used if desired. One part or section of the "L" of post engaging means 19 slides into slot 18 while the remaining half of the "L" fits firmly against the outer portion of post 11 to aid in holding the post in its upright position.

Figure 3:
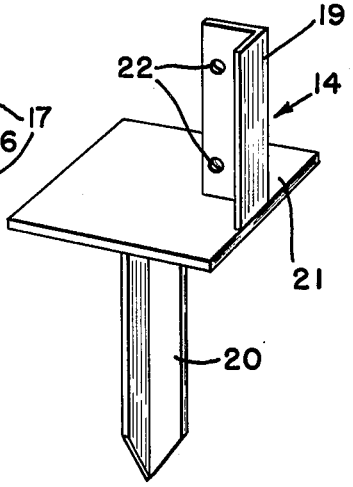
FIG. 3 illustrates an enlarged perspective view of the foundation member as shown in FIG. 2.
Figure 4:
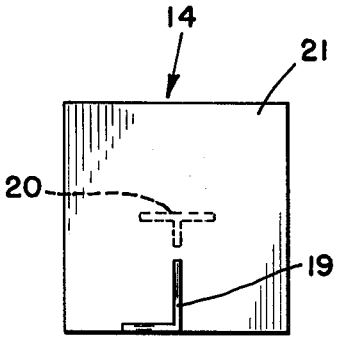
FIG. 4 is a top plan view of FIG. 3.

As shown in FIGS. 3 and 4, foundation member 14 has an L-shaped post engaging means and a substantially T-shaped earth-penetrating means 20 which may also be round or have other cross-sectional shapes similar to the post engaging means. Between earth-penetrating means 20 and post engaging means 19 is an abutting flange 21 upon which the terminal end of post 11 rests after assembly. As shown in FIG. 3, post engaging means 19 is atop said abutting flange 21 and is rigidly secured thereto.

It is possible and sometimes desirable to construct the foundation member from a single "L" or other shaped stake by attaching a post abutting flange thereto, whereby the foundation member is constructed of two instead of the usual three components.

To use the knockdown sign post assembly as shown in the present invention, earth penetrating means 20 of foundation member 14 such as in FIG. 3 is first urged or driven into the ground, to post abutting flange 21. In instances whereby the ground is frozen or hard, a steel pipe of sufficient inner diameter is slid over post engaging means 19 and the pipe can then be used to "hammer" foundation member 14 into the earth, as the pipe strikes the abutting flange 21. The terminal, slotted end of post 11 which may be constructed of metal, wood, plastic or other materials, is then aligned and slid over post engaging means 19 and is allowed to rest on abutting flange 21 which is shown designed to match the cross-sectional shape of post 11 but may also have a triangular or round design or other shapes. Thereafter, bolts 15 or other securing means are then inserted through holes provided in the post and through the openings 22 of post engaging means 19 as shown in FIG. 3 and are tightened to hold post 11 in place. Sufficient tightening causes the slot to contract and "pinch" or squeeze engaging means 19. Hence, the erection of the sign post takes no more than a few minutes for its completion. When it is desired to remove the sign post, the procedure is reversed with securing members 15 being first removed from post 11, post 11 then being slid up and away from post engaging means 19 and thereafter foundation member 14 is pulled or urged out of the ground.

Various modifications and improvements can be conceived of the foundation member and its attachement to post 11 which is illustrated as having a square cross-section, but other shapes can readily be employed such as rectangular, triangular or round configurations, and FIGS. 5 through 10 show various modifications and improvements. For example, foundation member 23 as shown in FIG. 5 includes a planar post-engaging means and stabilizing means 24 which aids in preventing foundation member 23 from being turned after being placed in the ground, or when round earth-penetrating stake 25 is employed and FIG. 11 demonstrates a round post 34.

FIG. 8 demonstrates another form of stabilizing means 27 that may be used on post abutting flange 28. Also, as shown in FIG. 9, a substantially V-shaped earth-penetrating means 29 may prove advantageous in aiding the stabilization of foundation means 26 of FIG. 8.

Another embodiment, foundation member 30, is shown in FIG. 10 with planar post engaging means 31 located at the sides of post abutting flange 32. Openings 33 are shown for securing bolts or rods to secure the sign post thereto.

Other modifications and improvements can be included such as having the post engaging means and earth-penetrating means constructed from a single piece of material stock, to which the post abutting flange is attached or by constructing the foundation member from a single piece of stock by properly forming or bending.

The drawings and examples mentioned are not to be considered as limitations of this invention and are shown for illustrative purposes.

I claim:

1. A post foundation member comprising: an earth penetrating means, a post abutting flange joined to said earth penetrating means along the upper portion of said earth penetrating means, a stabilizing means connected to said earth penetrating means, and a post engaging means, said post engaging means being substantially above said earth penetrating means and having inner and partial side outer post contacting sections, said inner post contacting section being affixed substantially perpendicular to said outer post contacting section, and said post engaging means having at least one opening therein for reception of a securing means.

2. A knockdown post assembly comprising: a foundation member, said foundation member having an earth penetrating means and a stabilizing means connected to said earth penetrating means, a post abutting flange joined to said penetrating means along the upper portion of said earth penetrating means, said flange including a post engaging means, said post engaging means having inner and partial side outer post contacting sections, said inner post contacting section being affixed substantially perpendicular to said partial side outer post contacting section, said post engaging means having at least one opening therein for reception of a securing means, a post member having an upper cross bar, said post member being slotted along its lower terminal end for receiving said inner posts contacting section while abutting against said partial side outer post contacting section, said post member having a securing means channel through its lower end for alignment with the opening in said post engaging means, securing means for insertion through said post member and said post engaging means, whereby said securing meand holds said post member in a firm upright posture and said post member remains in releasable engagement with said foundation member.

3. A knockdown post assembly as claimed in claim 2, wherein said earth-penetrating means is substantially V-shaped.

4. A knockdown post assembly as claimed in claim 2, wherein said earth-penetrating means comprises a round stake means.

5. A knockdown post assembly as claimed in claim 2, wherein said earth-penetrating means comprises a T-shaped stake means.

6. A knockdown post assembly as claimed in claim 2, wherein said earth-penetrating means comprises an L-shaped stake means.

7. A knockdown post assembly as claimed in claim 2, wherein said earth-penetrating means comprises an X-shaped stake means.

8. A knockdown post assembly as claimed in claim 2, wherein said post abutting flange is rectangularly-shaped.

9. A knockdown post assembly as claimed in claim 2, wherein said post abutting flange is triangularly-shaped.

10. A knockdown post assembly as claimed in claim 2, wherein said post abutting flange is round.

11. A knockdown post assembly as claimed in claim 2, wherein said post engaging means is substantially T-shaped.

12. A knockdown post assembly as claimed in claim 2, wherein said post engaging means is substantially L-shaped.

13. A knockdown post assembly as claimed in claim 2, wherein said post engaging means is substantially round.

14. A knockdown post assembly as claimed in claim 2, wherein said post engaging means is substantially V-shaped.

15. A knockdown post assembly as claimed in claim 2, wherein said post is substantially rectangularly-shaped.

16. A knockdown post assembly as claimed in claim 2, wherein said post is substantially round.

17. A knockdown post assembly as claimed in claim 2, wherein said post member is constructed of wood.

18. A knockdown post assembly as claimed in claim 2, wherein said post member is constructed of metal.

19. A knockdown post assembly as claimed in claim 2, wherein said post member is constructed of plastic.

* * * * *